United States Patent [19]

Johnson

[11] 3,965,626

[45] June 29, 1976

[54] BUILDING MODULE

[76] Inventor: Mark B. Johnson, P.O. Box 1578, Santa Cruz, Calif. 95061

[22] Filed: Nov. 21, 1974

[21] Appl. No.: 525,994

[52] U.S. Cl. ..... 52/79; 52/80; 52/236; 52/237; 52/648; 52/DIG. 10

[51] Int. Cl.[2] ..... E04H 3/00

[58] Field of Search ..... 52/79, 80, 81, 236, 52/237, 648, DIG. 10; 46/25, 26

[56] References Cited

UNITED STATES PATENTS

| | | | |
|---|---|---|---|
| 2,986,241 | 5/1961 | Fuller | 52/DIG. 10 |
| 3,468,503 | 9/1969 | Snibbe | 52/DIG. 10 |
| 3,618,273 | 11/1971 | Crandall | 52/237 |
| 3,685,221 | 8/1972 | Mangan | 52/236 |
| 3,785,096 | 1/1974 | Neuhardt | 52/79 |

FOREIGN PATENTS OR APPLICATIONS

| | | | |
|---|---|---|---|
| 485,079 | 1/1970 | Switzerland | 52/648 |

*Primary Examiner*—J. Karl Bell
*Attorney, Agent, or Firm*—Gerald L. Moore

[57] ABSTRACT

A type of building structure comprising a plurality of space modules each having a truncated tetrahedral shape.

3 Claims, 8 Drawing Figures

BUILDING MODULE

BACKGROUND OF THE INVENTION

In the erection of buildings and particularly with respect to those for use as home or office buildings, it has become increasingly the tendency to prefabricate portions of the building, or at least, to simplify the construction so that fewer components of different types need be put together to form the overall building.

With the use of fewer components or of standardized components, one can make more efficient use of the basic materials and precut the components. Further, to assemble such a structure, less training is needed for the workers. It is the overall purpose of this invention to provide a simplified yet strong space structure which can be used for various purposes such as homes and office buildings.

A space structure for building purposes having a truncated tetrahedral shape made of beams connecting the outer corners of the structure and including a plurality of ribs extending between the beams for adding rigidity to the structure. The ribs are connected to the beams where they join with sheeting being provided to cover the outer surfaces of a space structure to enclose the space within the structure.

DESCRIPTION OF THE INVENTION

Figure 1A:
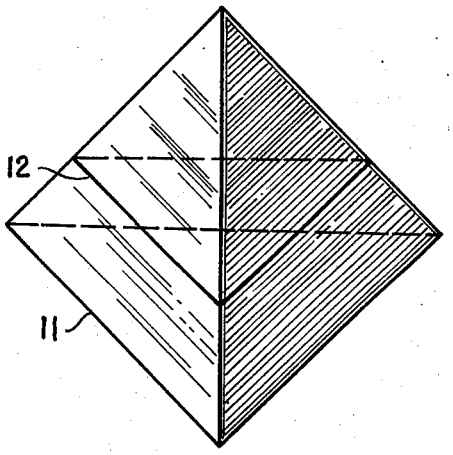
FIG. 1A shows a tetrahedron from which the subject space structure is derived.

In FIG. 1A is shown a tetrahedron which by definition is a space structure having four sides all of which are equilateral triangles. A tetrahedron is naturally a strong, rigid structure formed such that the outer walls are load-bearing yet can be relatively economically constructed.

Figure 1B:
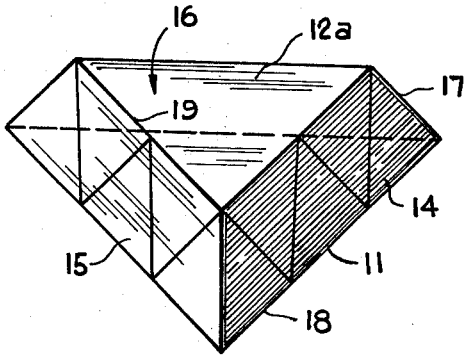
FIG. 1B shows a truncated tetrahedral form.

In accordance with the present invention, a space module comprising one or more truncated tetrahedral sections such as that shown in FIG. 1A formed by the base 11 and a plane cutting through the tetrahedron parallel to the base cutting the sides at the line 12. When separated from the tetrahedron, the truncated tetrahedral space structure appears as that shown in FIG. 1B having the base 11, a top surface 12A and sides 14, 15 and 16. Since the tetrahedron itself is a relatively simple, rigid and strong structure, such a section as that shown in FIG. 1B is likewise a similarly strong structure, particularly if there is a whole number ratio between the length of the edge 17, the base length 18 and the top edge length 19. In other words, it has been found that a rigid space module is formed if the ratio of the side edge, base edge and top edge is 1:3:2, 1:4:3, 1:2:1, or possibly, 1:1:1. In such a structure the three side walls that form the space module can be identically resolved mathematically under simple truss computations comprising a plurality of beams and ribs forming equilateral triangles.

Figure 3:
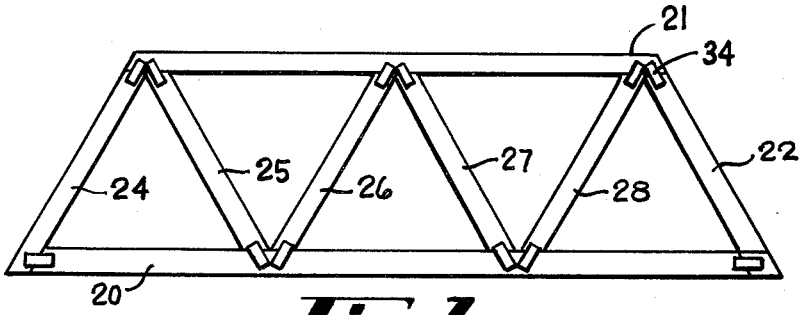
FIG. 3 is a side plan view of a truncated tetrahedral space structure.

With reference to FIG. 3, one side of a space module is illustrated formed of a bottom beam 20, a top beam 21 and side beams 22 and 24. Connecting the top and bottom beams are a plurality of ribs 25, 26, 27 and 28. The adjacent ribs and beams naturally form equilateral triangles when the truncated tetrahedral space structure is formed of the whole number ratios described heretofore. Such a structure has been found very rigid and strong while making use of the forming materials in a very economical manner. The other sides of the space module are identical.

Figure 2A:
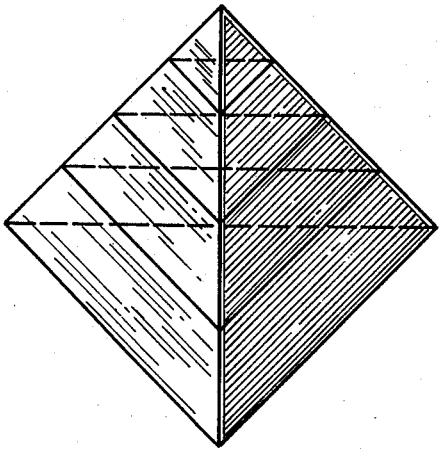
FIG. 2A shows a tetrahedron with various truncated sections illustrated.
Figure 2B:
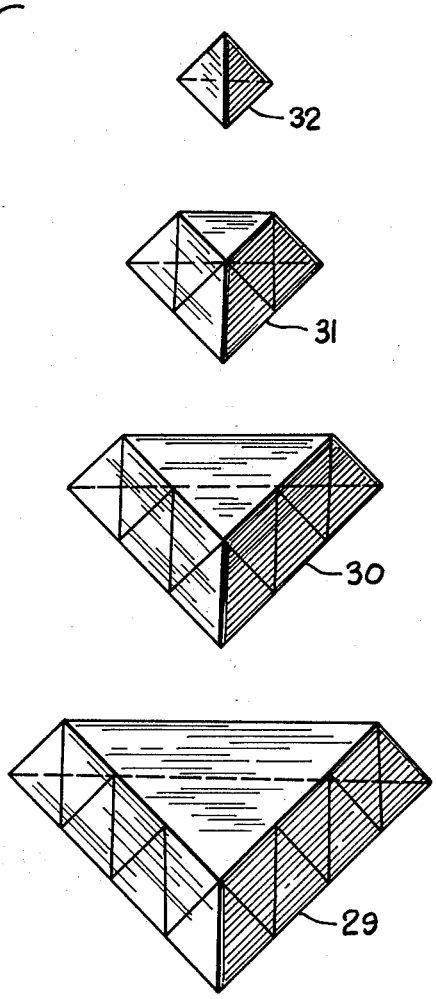
FIG. 2B shows the various sections of the tetrahedron of FIG. 2A separated.

As shown in FIG. 2B, when the tetrahedron is truncated in the manner described to form whole number ratio truncated sections there results the section 29 having a side edge, base edge and top edge ratio of 1:4:3 and a section 30 having a ratio of 1:3:2, a section 31 having a ratio of 1:2:1 and a space structure 32 having a ratio of 1:1:0.

Figure 4A:
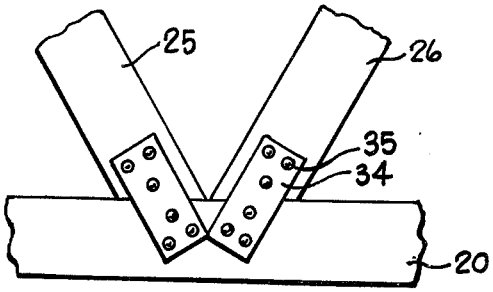
FIGS. 4A and 4B are enlarged views of types of rib and beam joints.
Figure 4B:
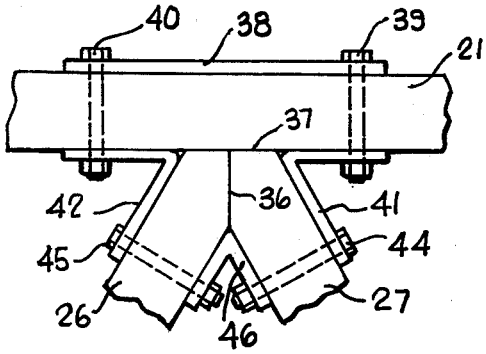

For joining the beams and ribs, various means can be employed. However, one preferred means is shown in FIG. 4A illustrating in enlarged view the joining of the ribs 25 and 26 with the bottom beam 20 of FIG. 3. Herein the ribs are cut at an angle such that they butt at the ends in side-by-side relationship against the beam 20. The rib-beam joint is held together by a series of plates 34 held preferably six or more bolts 35 passing through the rib and beam. Of course it should be understood that lag bolts or other means could be used if desired and if structurally sufficient. By this structure the ribs of all of the modules can be cut uniformly with the same being true of the bottom beams and also the top beams of the space structure. Thereafter the identical plates are utilized for joining the ribs and beams thereby reducing substantially the number of different components which must be utilized for forming this space module.

A second type of joint is shown in FIG. 1B wherein the rib ends are cut at two angles and joined together in abutting relationship as well as being fixed to the beam. In this instance, the beam 21 and ribs 26 and 27 are shown with the rib ends being cut at two angles illustrated by the lines 36 and 37. Thereafter a plate 38 is fixed to the beam by the bolts 39 and 40 which also pass through an angle plate 41 and 42 respectively which fits in the space between the beam and adjacent rib. A bolt 44 and 45 passes through the angle plates 41 and 42 respectively to also hold a third angle plate 46 between the adjacent ribs. This structure offers a first advantage of presenting a flat face of the beam and rib to which sheeting means can be fixed for enclosing the space within the module. In addition, if desired, the beam 21 (which can be either a top or bottom beam), can be made up of separate beam sections which are joined somewhere between the bolts 39 and 40 in a butt joint and held rigidly together by the plates forming the rib-beam joint. Naturally this structure by being more complicated is also more expensive to fabricate but in some embodiments might be preferred.

The usual truncated tetrahedral space module described herein forms a single story structure suitable for a home or office building. Because of ceiling requirements, the usual height of such a structure is normally 9 feet. Because of this requirement for ceiling height, say 9 feet, an edge length would normally be 11 feet with a base of 33 feet and a top beam length of 22 feet. For home structures, this presents an enclosed square footage of approximately 300 square feet for that chosen ceiling height. Of course the structure can be utilized upside down thereby reducing the floor space to somewhere in the order of 200 square feet but in certain instances presenting other advantages. The face that the module of this configuration is rigid enough to not require internal load bearing walls makes all of the floor space usable.

Naturally it should be understood that the sides can include windows which usage might determine whether the space structure is employed right side up, that is, with the small beam on top or upside down, that is, with the larger length beam on top. For instance if the small beam is on top, more sun is permitted to enter the windows in the side walls. However, with the truncated tetrahedral shape upside down, the windows are shaded and also partially shielded from rain or snow. Such shielding can minimize the problems of sealing and cleaning as well as presenting a preferred aesthetic appearance in some applications.

Figure 5:
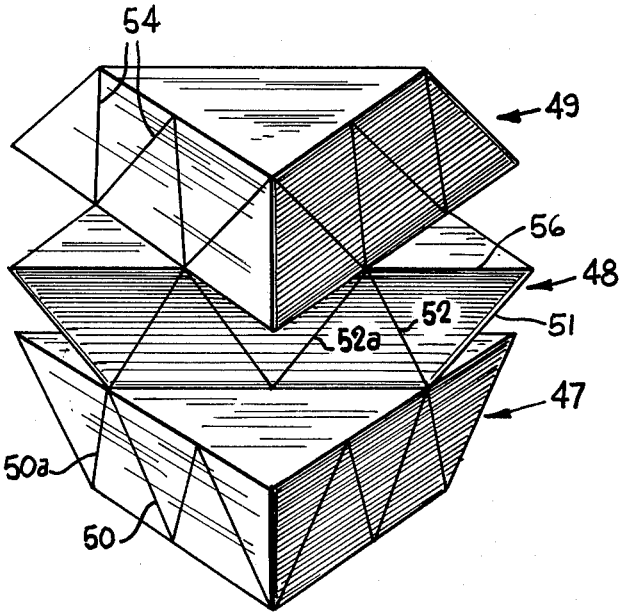
FIG. 5 shows several truncated tetrahedral shapes stacked to form a building structure.

Of course the modules can also be stacked together to form multi-story structures as shown in FIG. 5. Herein a plurality of truncated tetrahedral sections 47, 48 and 49 stacked one above the other to form such a multi-story structure. Each of these truncated sections has a side edge, base edge and top edge length ratio of 1:3:2. Also each module 47, 48 and 49 includes a plurality of ribs 40, 52 and 54 which together with the adjoining beams form equilateral triangles thereby adding rigidity to the structure.

As a further feature of the invention, stacking of the truncated tetrahedral sections is accomplished without need of internal load-bearing walls by always joining the modules at the points where beams and ribs connect thereby connecting the structures at the load bearing joints for a more economical yet rigid stucture. Thus the ribs 50 and 50A of the section 47 join at the juncture of the edge 51 and the beam 52 of the module 48. Similarly, the ribs 54 of the section 49 join where the beam 56 and the ribs 52 and 52A join together within the space module 48. Because of the whole number ratio of the dimensions of the modules and the equilateral triangle rib and beam configuration the ribs and beams of each adjacent stacked module all join together to form a good load supporting multilevel structure.

By utilizing space modules having whole number ratios thereby having rib and beam members forming equilateral triangles the structure at the rib and beam joints is simplified because with the same height truncated section, that is, the ceiling height of each level being the same, the equilateral triangles naturally are equal in size for each level. Therefore the stacking of the structures with the rib-beam joints together at all points around the outer periphery of each story is possible without adding additional load-bearing components. Naturally in such a structure also, the outer walls are the only loadbearing walls needed because the load is transferred directly from one module to the next supporting one through the ribs.

The invention claimed is:

1. A space structure for building purposes including a plurality of space modules stacked one above the other with each space module comprising:

a plurality of beams joined together to form a truncated tetrahedral shape having side walls;

a plurality of ribs extending between the beams forming the side walls;

means connecting the rib ends to the adjacent beam to form rib-beam joints;

means fastening the space modules together in stacked arrangement such that at least some of the side walls on one side of the structure do not lie in the same plane, and sheeting means covering the side walls and exposed surfaces of the modules thereby to form an enclosed multi-level space structure.

2. A space structure as defined in claim 1 wherein the ribs and adjacent beams each form equilateral triangles.

3. A space structure as defined in claim 2 wherein the modules are stacked such that the rib-beam joints of adjacent stacked modules are abutting thereby to form a rigid load-bearing structure.

* * * * *